US011547893B1

(12) United States Patent
Line

(10) Patent No.: US 11,547,893 B1
(45) Date of Patent: Jan. 10, 2023

(54) PORTABLE FRAME-MOUNTED TRAINING APPARATUS AND METHOD OF USE

(71) Applicant: Porta-Hang, LLC, Franklin, TN (US)

(72) Inventor: Jarrod Kevin Line, Brentwood, TN (US)

(73) Assignee: Porta-Hang, LLC, Franklin, TN (US)

( * ) Notice: Subject to any disclaimer, the term of this patent is extended or adjusted under 35 U.S.C. 154(b) by 41 days.

(21) Appl. No.: 17/148,847

(22) Filed: Jan. 14, 2021

Related U.S. Application Data

(60) Provisional application No. 63/017,694, filed on Apr. 30, 2020, provisional application No. 62/961,644, filed on Jan. 15, 2020.

(51) Int. Cl.

| | |
|---|---|
| ***A63B 21/16*** | (2006.01) |
| ***A63B 23/12*** | (2006.01) |
| ***A63B 21/00*** | (2006.01) |
| ***A63B 23/035*** | (2006.01) |
| *A63B 69/00* | (2006.01) |

(52) U.S. Cl.
CPC ..... *A63B 21/1636* (2013.01); *A63B 21/4035* (2015.10); *A63B 23/03525* (2013.01); *A63B 23/1218* (2013.01); *A63B 69/0048* (2013.01)

(58) Field of Classification Search
CPC ..... A63B 21/1636; A63B 21/4035; A63B 23/03525; A63B 69/0048; A63B 23/1218
See application file for complete search history.

(56) References Cited

U.S. PATENT DOCUMENTS

| | | | | |
|---|---|---|---|---|
| 3,716,232 | A * | 2/1973 | Johnson | A63B 1/005 482/40 |
| 5,048,825 | A * | 9/1991 | Kelly | A63B 21/154 482/904 |
| 5,429,571 | A * | 7/1995 | Smith | A63B 23/1209 482/904 |
| 5,776,033 | A * | 7/1998 | Brown | A63B 21/1636 482/40 |
| 5,947,875 | A * | 9/1999 | Cone | A47D 13/107 482/904 |
| 8,808,147 | B2 * | 8/2014 | Gillespie | A63B 1/00 482/40 |
| 9,192,808 | B2 * | 11/2015 | Stone | A63B 21/068 |
| 10,780,311 | B1 * | 9/2020 | Gadd | A63B 21/00047 |
| 2011/0240808 | A1 * | 10/2011 | Skipper | A63B 69/0048 248/201 |

(Continued)

*Primary Examiner* — Andrew S Lo
(74) *Attorney, Agent, or Firm* — Master Key IP, LLP; Jeromye V. Sartain

(57) ABSTRACT

A portable frame-mounted training apparatus for removable installation on a door frame or other structure having at least one horizontal trim, the apparatus having a mounting member having a front wall with a receiver for selective removable receipt of a grip member and further having a top wall extending rearwardly from the front wall, the top wall configured to engage the door frame first trim, and a capture member extending rearwardly from the mounting member and having an upper face configured to contact the door frame or other structure somewhat opposite of the first trim, whereby engagement of the top wall with the first trim serves as a pivot point for the apparatus to rotationally bring the upper face of the capture member into contact with the door frame or other structure and thereby secure the apparatus on the door frame or the like.

21 Claims, 8 Drawing Sheets

(56) References Cited

U.S. PATENT DOCUMENTS

| | | | | |
|---|---|---|---|---|
| 2011/0245040 | A1* | 10/2011 | Skipper | A63B 9/00 482/38 |
| 2012/0129658 | A1* | 5/2012 | Hunt | A63B 23/1218 482/38 |
| 2014/0221163 | A1* | 8/2014 | Mcbride | A63B 21/00047 482/40 |
| 2014/0302968 | A1* | 10/2014 | Velikin | A63B 21/068 482/40 |
| 2015/0024907 | A1* | 1/2015 | Ross | A63B 21/1636 482/39 |
| 2015/0105186 | A1* | 4/2015 | Block | A63B 71/04 473/416 |
| 2016/0166874 | A1* | 6/2016 | Sheeler | A63B 1/00 482/40 |
| 2016/0303419 | A1* | 10/2016 | Karpachevskyy | A63B 21/4035 |
| 2020/0384306 | A1* | 12/2020 | Carter | A63B 21/1636 |

* cited by examiner

PORTABLE FRAME-MOUNTED TRAINING APPARATUS AND METHOD OF USE

RELATED APPLICATIONS

This non-provisional patent application claims priority pursuant to 35 U.S.C. § 119(e) to and is entitled to the filing date of U.S. Provisional Patent Application Ser. No. 62/961,644 filed Jan. 15, 2020, and entitled "Portable frame mounted training device" and further to the filing date of U.S. Provisional Patent Application Ser. No. 63/017,694 filed Apr. 30, 2020, and entitled "Adjustable portable frame mounted training device." The contents of the aforementioned applications are incorporated herein by reference.

BACKGROUND

The subject of this patent application relates generally to training devices, and more particularly to specialized portable training devices configured for being non-permanently mounted on a door frame or other structure to facilitate body weight exercises.

The following description includes information that may be useful in understanding the present invention. It is not an admission that any of the information provided herein is prior art or relevant to the presently claimed invention, or that any publication specifically or implicitly referenced is prior art.

Applicant(s) hereby incorporate herein by reference any and all patents and published patent applications cited or referred to in this application, to the same extent as if each individual publication or patent application were specifically and individually indicated to be incorporated by reference. Where a definition or use of a term in an incorporated reference is inconsistent or contrary to the definition of that term provided herein, the definition of that term provided herein applies and the definition of that term in the reference does not apply.

By way of background, in sports such as rock climbing and other high performance athletic activities, repetitive training and strengthening of the arms, hands, and fingers is highly valued. One classic form of body weight exercise for such training and strengthening is pull-ups, which typically requires a bar or other fixed equipment overhead for an athlete to grasp and pull themselves up by their arms and hands and then repeat. Particularly in the sport of rock climbing, it is preferred that any such exercise equipment be configured with grips or holds of various kinds so that the hands and fingers can be appropriately trained and strengthened as well.

Existing devices again require a fixed anchor point above the user, such as a bar or other hardware that is permanently installed often on a wall. Other equipment may be free-standing but is not easily portable. Some pull-up bars that are available are even configured to be mounted non-permanently on or over a doorway or top door frame, but those still are relatively bulky and so not easily transported and also provide no means for securing and using rock climbing grips or holds. What has been needed and heretofore unavailable is a relatively small and easily portable training device that can be non-permanently mounted on a door frame or other structure while providing for rock climbing holds for a user to grasp while engaging in training and strengthening body weight exercises such as pull-ups.

Aspects of the present invention fulfill these needs and provide further related advantages as described in the following summary.

SUMMARY

Aspects of the present invention teach certain benefits in construction and use which give rise to the exemplary advantages described below.

The present invention solves the problems described above by providing a portable frame-mounting training apparatus for removable installation on a door frame or other structure having at least one horizontal trim. In at least one embodiment, the training apparatus comprises a mounting member having a front wall with a receiver and further having a top wall extending rearwardly from the front wall, the top wall configured to engage the door frame first trim, and a capture member extending rearwardly from the mounting member and having an upper face configured to contact the door frame or other structure somewhat opposite of the first trim, wherein the receiver formed in the front wall of the mounting member is configured for selective removable receipt of a grip member for grasping during a training exercise employing the apparatus, and whereby engagement of the top wall of the mounting member with the first trim serves as a pivot point for the apparatus to gravitationally bring the upper face of the capture member into contact with the door frame or other structure and thereby secure the apparatus on the door frame or the like.

Other objects, features, and advantages of aspects of the present invention will become more apparent from the following detailed description, taken in conjunction with the accompanying drawings, which illustrate, by way of example, the principles of aspects of the invention.

BRIEF DESCRIPTION OF THE DRAWINGS

The accompanying drawings illustrate aspects of the present invention. In such drawings.

Figure 1:
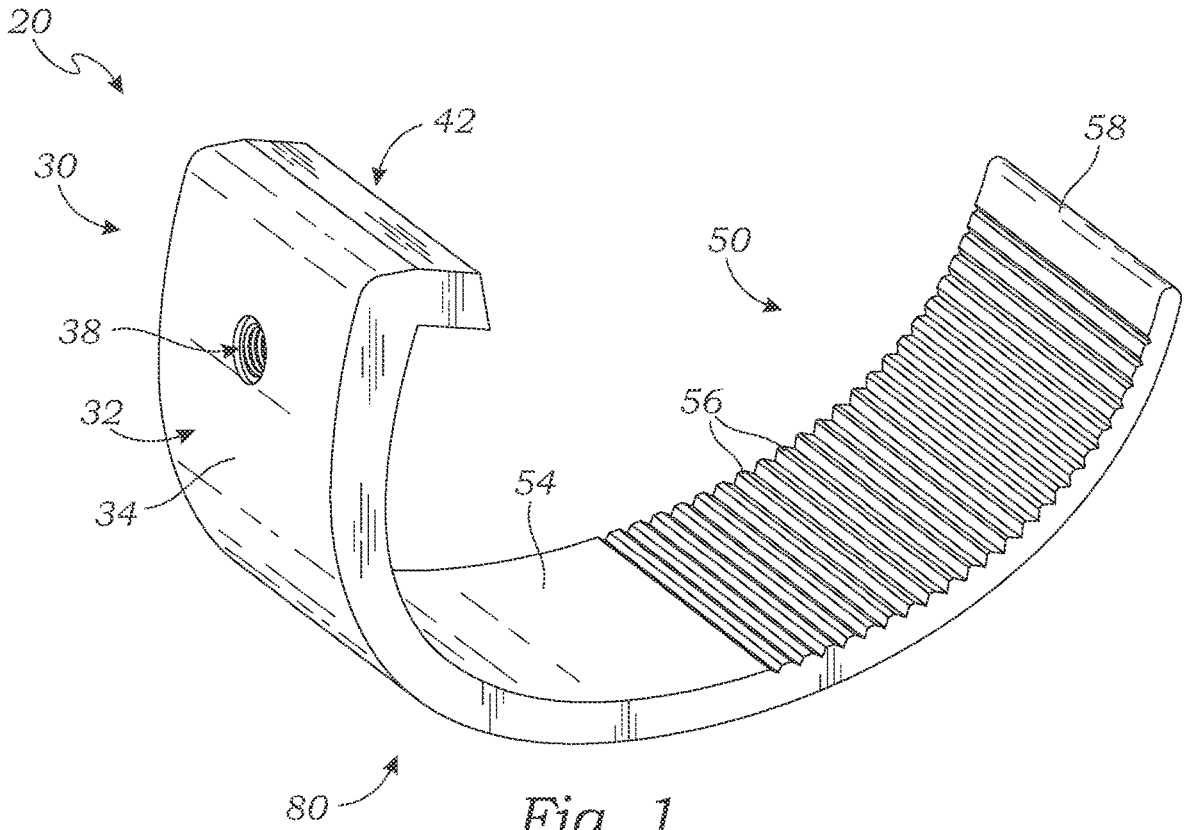
FIG. 1 is a perspective view of an exemplary portable frame-mounted training apparatus, in accordance with at least one embodiment.

The above described drawing figures illustrate aspects of the invention in at least one of its exemplary embodiments, which are further defined in detail in the following description. Features, elements, and aspects of the invention that are referenced by the same numerals in different figures represent the same, equivalent, or similar features, elements, or aspects, in accordance with one or more embodiments. More generally, those skilled in the art will appreciate that the drawings are schematic in nature and are not to be taken literally or to scale in terms of material configurations, sizes, thicknesses, and other attributes of an apparatus according to aspects of the present invention and its components or features unless specifically set forth herein.

DETAILED DESCRIPTION

The following discussion provides many exemplary embodiments of the inventive subject matter. Although each embodiment represents a single combination of inventive elements, the inventive subject matter is considered to include all possible combinations of the disclosed elements. Thus, if one embodiment comprises elements A, B, and C, and a second embodiment comprises elements B and D, then the inventive subject matter is also considered to include other remaining combinations of A, B, C, or D, even if not explicitly disclosed.

While the inventive subject matter is susceptible of various modifications and alternative embodiments, certain illustrated embodiments thereof are shown in the drawings and will be described below in detail. It should be understood, however, that there is no intention to limit the invention to any specific form disclosed, but on the contrary, the inventive subject matter is to cover all modifications, alternative embodiments, and equivalents falling within the scope of the claims.

Figure 2:
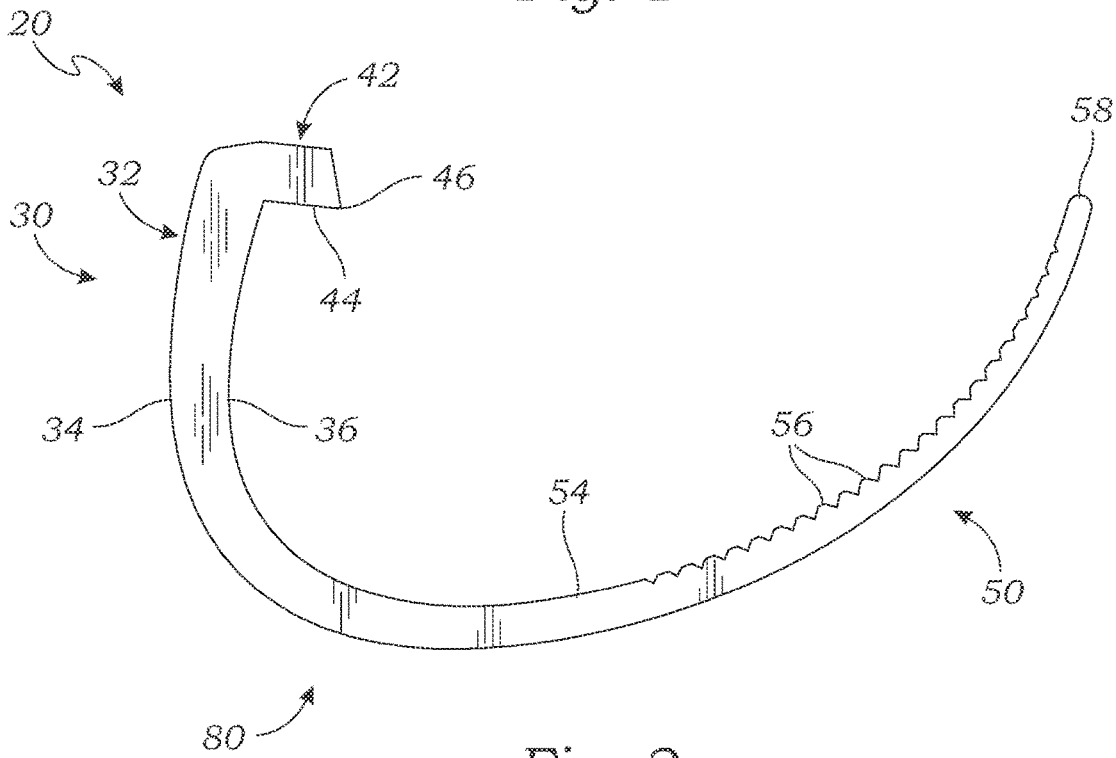
FIG. 2 is a side view thereof, in accordance with at least one embodiment.

Turning now to FIGS. 1 and 2, there are shown perspective and side views of an exemplary embodiment of a portable frame-mounted training apparatus 20 according to aspects of the present invention. The training apparatus 20 comprises, in the exemplary embodiment, a forward mounting member 30 and an interconnected rearward capture member 50. In the illustrated embodiment, the mounting and capture members 30, 50 are integral, though it will be appreciated that such is not necessary and may instead involve separate engaged or engageable components, as further demonstrated by the alternative exemplary embodiment of FIGS. 9-11 discussed further below. Moreover, even where the mounting and capture members 30, 50 are integral front to back, they may comprise two or more sections lengthwise to form the final apparatus 20 having the desired width, as will be appreciated with reference to the alternative exemplary embodiment of FIGS. 5-8, which may provide other advantages in construction and use as described herein. In any such embodiment of a training apparatus 20 according to aspects of the present invention, a portion of either or both the forward mounting member 30 and/or the interconnected rearward capture member 50 forms a relatively flexible connecting portion 80 that in part defines the mechanical properties of the apparatus 20 and specifically the interplay between the mounting and capture members 30, 50 as the apparatus 20 is in use and under load so as to secure the apparatus 20 on a door frame D (FIGS. 3, 4, 12 and 13). Those skilled in the art will thus appreciate that while various exemplary embodiments of a portable frame-mounted training apparatus 20 according to aspects of the present invention are shown and described herein, the invention is not so limited but instead may take a number of other forms without departing from its spirit and scope. Moreover, it will be appreciated that while a traditional door frame D, including opposite horizontal first and second trims T1, T2, is shown and described as the context in which a training apparatus 20 according to aspects of the present invention is employed, the invention is clearly not so limited and may be employed in conjunction with a wide variety of structures, now known or later developed, beyond a traditional door frame D as shown and described herein, which is to be expressly understood as illustrative only and non-limiting. By way of further illustration and not limitation, a portable frame-mounted training apparatus 20 according to aspects of the present invention may be employed in conjunction with any opening in a wall or other structure about or adjacent which at least one somewhat horizontal trim piece or other component is affixed, the typical doorway or door frame D being but one example. Accordingly, any reference to "door frame" herein or in the appended claims is to be broadly construed as any such structure having a trim or other component and a nearby opening in the structure.

Figure 3:
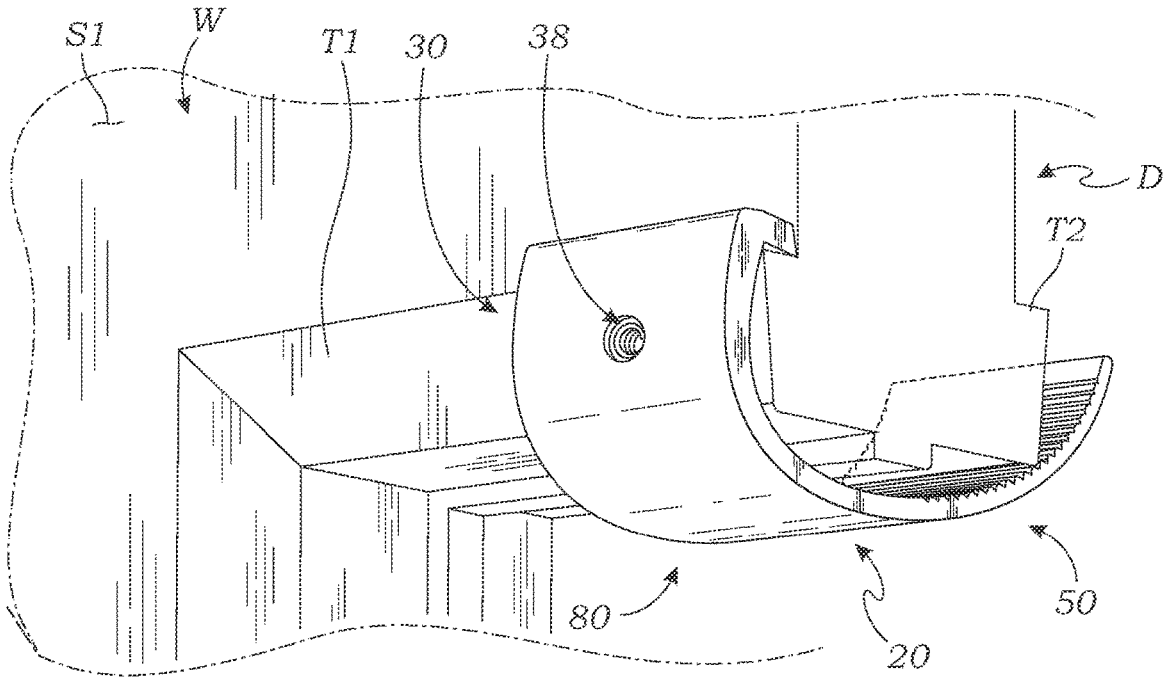
FIG. 3 is a reduced-scale perspective view thereof as temporarily mounted on a door frame, illustrated partially and schematically, in accordance with at least one embodiment.
Figure 4:
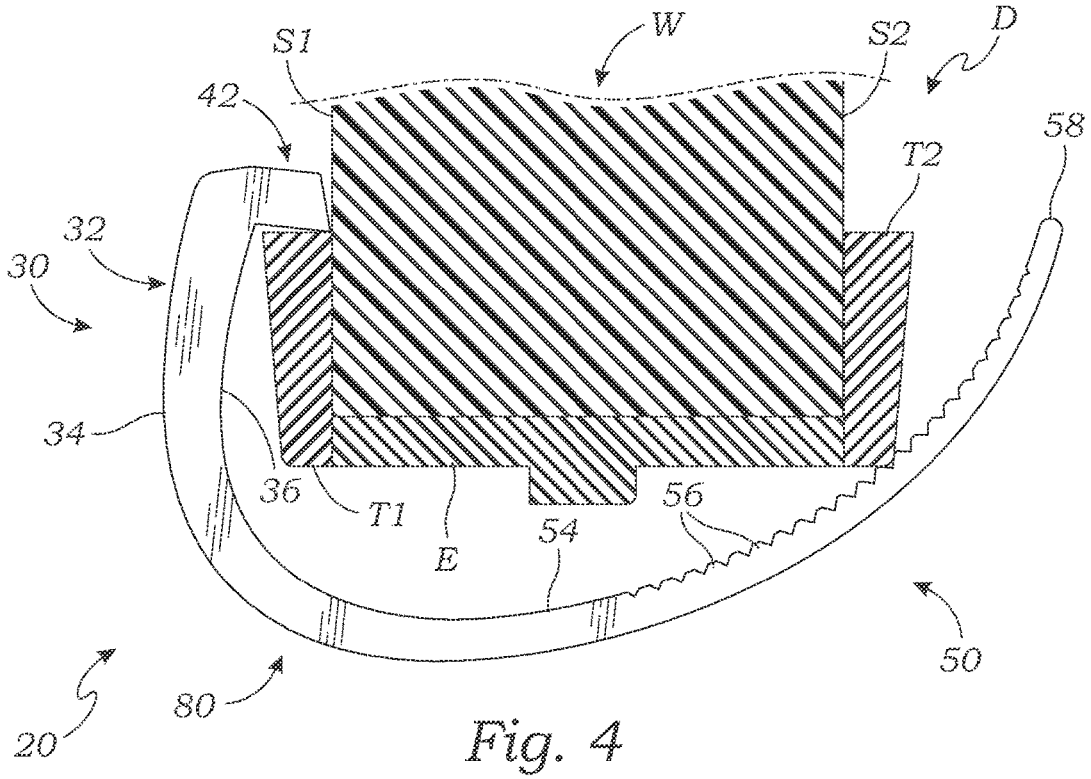
FIG. 4 is a side view thereof as again temporarily mounted on a door frame, illustrated partially and schematically now in section, in accordance with at least one embodiment.

With continued reference to FIGS. 1 and 2, the illustrated mounting member 30 of the training apparatus 20 includes a roughly vertical front wall 32 and a roughly perpendicular or horizontal top wall 42 that defines a ledge by which the device is positioned or hangs on the door frame D (FIGS. 3 and 4). While the front and top walls 32, 42 are shown as being integral or unitary, it will be appreciated that such is not required, and the front and top walls 32, 42 need not necessarily be "vertical" and "horizontal" per se, but instead may be in other orientations in configuration or use and may be more continuous in their relative orientation to each other, for example. The front wall 32, or its outer face 34 and/or inner face 36 specifically, may be planar or flat or be curved, in whole in part, or really formed of any desirable geometry according to aspects of the present invention. In such front wall 32 there is formed at least one receiver 38—where one such receiver 38 is provided it may be formed somewhat centrally in the front wall 32, though not necessarily. Generally, the receiver 38 is configured for selective receipt or installation of a grip member 90 (FIGS. 12 and 13), more about which is said below. Depending on the geometry of any such grip member 90, the front wall 32 and particularly its outer face 34 may be formed accordingly to achieve somewhat positive or flush engagement between the mounting member 30 and the grip member 90. In the exemplary embodiment of the training apparatus 20 of FIGS. 1-4, the at least one receiver 38 comprises a somewhat central threaded hole configured to accommodate a screw-type fastener 98 (FIG. 12) for selectively mounting the selected grip member 90. Such threaded hole receiver 38 may be a through-hole or formed entirely through the front wall 32 so as to communicate between the outer and inner faces 34, 36 or may be a fixed depth hole only communicating with the outer face 34 of the front wall 32 for access by any fastener 98 for selective installation of a grip member 90. Those skilled in the art will appreciate that a wide variety of receivers 38 for temporarily mounting a grip member 90 on the front wall 30 of the apparatus 20, whether now known or later developed, are possible without departing from the spirit and scope of the invention, such that threaded holes and fasteners are merely illustrative and non-limiting. And any such threaded receiver 38 may have U.S. or metric threads of any appropriate size. By way of further illustration and not limitation, such receivers 38 may include threaded nuts, snap- or press-fit connectors, tongue-and-groove or keyed connectors, slotted or bayonet-style engagement, and magnetic couplings. And in the case of the receiver 38 having or defining a threaded coupling, any female threaded feature on or in the front wall 32 of the apparatus 20 may be formed integrally with the front wall 32, as by cutting, tapping, molding, or otherwise forming the thread pattern within the receiver hole, or by inserting a separate threaded nut 100 (FIG. 12) or over-molding the mounting member 30 onto any such nut or other feature, including but not limited to a weld nut 100 or the like having a flange on one side from which extends a boss having the desired female thread formed therein, the outside diameter or dimension of the boss or other such feature of a weld nut 100 or the like would then substantially correspond to the inside diameter or dimension of the hole in the front wall 32 so as to then define the receiver 38, it being appreciated that in such an exemplary embodiment the flange of the weld nut 100 would be oriented toward the inner face 36 of the front wall 32 of the mounting member 30, more about which is said in connection with the alternative exemplary embodiment of FIGS. 5-8. In other alternative embodiments even of a threaded-type engagement between the mounting member 30 and the grip member 90, it will be appreciated that the mounting member 30 may instead be formed with a boss or post having a male thread form extending outwardly from the outer face 34 of the front wall 32 with a corresponding threaded hole or other feature provided in the grip member 90. Again, those skilled in the art will appreciate that a variety of such configurations of the mounting member 30 and related features are possible according to aspects of the present invention, such that the illustrated embodiments are to be understood as merely exemplary.

Further related to the mounting member 30 of the training apparatus 20, as also seen in FIGS. 1 and 2 and noted previously, a roughly horizontal top wall 42 may be formed so as to extend somewhat perpendicularly from the roughly vertical front wall 32, it specifically extending rearwardly or away from the inner face 36 of the front wall 32 at the upper or terminal end of the front wall 32 so as to again form a ledge for engagement with a door frame D (FIGS. 3 and 4). Such top wall 42 defines a bottom face 44 and may itself terminate rearwardly in a top wall edge 46. In the exemplary embodiment, the top wall bottom face 44 is substantially planar and substantially perpendicular to the front wall inner face 36 while the top wall edge 46 is slanted from bottom to top or is at an angle relative to the front wall inner face 36, more about which is said below in connection with FIGS. 3 and 4 illustrating the training apparatus 20 mounted on a door frame D, particularly as to the engagement of the top wall 42 with the door frame D. More precisely, in at least one exemplary embodiment, the angle between the roughly horizontal top wall 42 and the roughly vertical front wall 32, or between the top wall bottom face 44 and the front wall inner face 36, is short of perpendicular or slightly acute or, for example, is in the range of eighty to ninety degrees (80-90°). And by way of further illustration and not limitation, the angle between the top wall bottom face 44 and the top wall edge 46 is also slightly acute or, for example, is in the range of sixty to eighty degrees (60-80°). As best seen in the side view of FIG. 2, the interface between the front and top walls 32, 42, or particularly between the inner face 36 of the front wall 32 and the bottom face 44 of the top wall 42, defines a transition that may be a sharp or defined corner as shown or a filleted or radiused joint or intersection as shown in the alternative embodiment of FIGS. 5-8. Those skilled in the art will appreciate that a wide variety of such geometries and their mechanical properties or effects may be employed according to aspects of the present invention beyond those shown and described without departing from its spirit and scope, as will be further appreciated with reference to the alternative exemplary embodiments herein.

Staying with FIGS. 1 and 2, the capture member 50 of the exemplary portable frame-mounted training apparatus 20 according to aspects of the present invention, again integral with the mounting member 30 in the illustrated embodiment, is a somewhat curved rearwardly extending component having an upper face 54 configured for selectively contacting the door frame D (FIGS. 3 and 4) in use. The capture member 50 may be of a somewhat constant thickness or profile or may be somewhat tapered rearwardly as illustrated. Further optionally, a rearward portion of the upper face 54 of the capture member 50 may be formed with crosswise or lateral ridges 56 or other such surface features to aid in frictionally engaging the door frame D. Though it will be appreciated that the capture member upper face 54 may instead be smooth, as illustrated in the alternative exemplary embodiments of FIGS. 5-11, whether or not such surface 54 is formed or treated for enhanced frictional engagement with any mating surfaces. Any such surface treatments may also be provided or formed on the bottom face 44 of the top wall 42 of the mounting member 30 as well. Those skilled in the art will appreciate that effectively it is the cooperation of the top wall 42 of the mounting member 30 and the upper face 54 of the capture member 50 in conjunction with any interconnecting or intermediate relatively flexible portion 80 that ensures selective and positive engagement with the door frame D, as explained more fully below in connection with FIGS. 3 and 4.

In forming the training apparatus 20, including the mounting member 30 and the capture member 50, again whether integral or separate, or any other such feature or component of the apparatus 20, it will be appreciated that any appropriate materials and methods of construction now known or later developed may be employed, including but not limited to metals such as steel, aluminum, alloys, and the like and a variety of plastics such as polypropylene, polystyrene, polyvinyl chloride ("PVC"), acrylonitrile butadiene styrene ("ABS"), polyethylenes such as high density polyethylene ("HDPE") and low density polyethylene ("LDPE"), polycarbonate, polyurethane, nylon, and other such plastics, thermoplastics, thermosetting polymers, and the like, any such components being fabricated or formed as through injection molding, casting, extrusion, machining, stamping, forming, or any other such technique now known or later developed. Relatedly, such components may again be formed integrally or may be formed separately and then assembled in any appropriate secondary operation employing any assembly technique now known or later developed, including but not limited to fastening, bonding, welding, over-molding or coining, press-fitting, snapping, or any other such technique now known or later developed, whether permanent or temporary. Those skilled in the art will fundamentally appreciate that any such materials and methods of construction are encompassed within the scope of the invention, any exemplary materials and methods in connection with any and all embodiments thus being illustrative and non-limiting.

Dimensionally, the overall size and scale or proportionality of any such training apparatus 20 may vary widely based on a number of factors and contexts—in the present exemplary context of conventional doorway or door frame mounting, the overall length of the apparatus 20, or the maximum dimension from the outer face 34 of the front wall 32 of the mounting member 30 to the rearward tip 58 of the capture member 50, may be on the order of nine inches (9 in.), the overall height of the apparatus 20, or the maximum dimension from the upper end of the mounting member 30, or the top wall 42 thereof, to the lower surface of the capture member 50, may be on the order of six inches (6 in.), and the overall width across the apparatus 20, whether at the mounting member 30 or the capture member 50 or both, may be on the order of four inches (4 in.), though again it will be appreciated that a wide range of sizes may be employed, in part depending on the particular geometry or configuration of the training apparatus 20 and the size of the doorway or door frame D (FIGS. 3 and 4) or other structure on which the apparatus 20 is to be employed. It is noted by way of further illustration and not limitation that the width of the apparatus 20 may be somewhat constant as in the exemplary embodiments or may vary along the length and/or height of the apparatus 20 as desired, such that the somewhat constant width apparatus 20 is to be understood is merely illustrative and non-limiting. The thickness of the apparatus 20 particularly at the mounting member 30 may be approximately one-half inch to one inch (0.5-1.0 in.), and the top wall 42 may extend from the inner face 36 of the front wall 32 approximately three-quarter inch (0.75 in.), which it will be appreciated is roughly at least the depth or thickness of common door trim T1, T2 (FIGS. 3 and 4) so as to sufficiently seat thereon while spacing the front wall inner face 36 from the door trim T1, T2. It will be further appreciated that such a thickness of the mounting member 30 would be sufficient for forming threads or embedding a threaded member within the front wall 32 for then temporarily securing a grip member 90 (FIGS. 12 and 13) as described herein, though once more a variety of means now known or later developed for mounting such a grip member 90 on the apparatus 20 is possible, with the geometry (configuration and/or size) of the apparatus 20 adjusted accordingly within the spirit and scope of the invention. Staying with the exemplary embodiment of FIGS. 1 and 2, the upwardly curved capture member 50 is configured such that its rearward tip 58 is at roughly the same elevation as the top wall 42 of the mounting member 30, though again other arrangements and geometrical configurations of the capture member 50 are possible, as will be further appreciated with reference to the alternative exemplary embodiments of FIGS. 5-11. And more generally, once again, other sizes and shapes or configurations of the training apparatus 20 are possible according to aspects of the present invention beyond those shown and described herein, which are expressly illustrative and non-limiting.

Turning to FIGS. 3 and 4, in use, the exemplary portable frame-mounted training apparatus 20 according to aspects of the present invention may be positioned on a door frame D by simply placing the mounting member 30 on or in contact with the first trim T1 of the door frame D such that the capture member 50 is oriented rearwardly and is in contact with the opposite second trim T2 of the door frame D. Again, a second trim T2 opposite the first trim T1, though typically found in such door frame D construction, is not necessary, with the capture member 50 able to contact or rest or seat against any structure of the doorway or other opening opposite the first trim T1, such as the head stop E or wall W itself, and specifically its opposite second surface S2, such that once more it should be appreciated that use of the apparatus 20 in the context of a typical door frame D having opposite horizontal first and second trims T1, T2 is merely illustrative and non-limiting. Those skilled in the art will appreciate that in any such context or use, gravity alone would serve to maintain the apparatus 20 so positioned on the door frame D or the like, without the need for any other means of attachment. That is, it will be appreciated that the point of contact between the mounting member 30, and particularly the top wall 42 and more particularly its edge 46 (FIG. 2), with the top surface of the front or first trim T1 serves as a pivot point or fulcrum for the rest of the apparatus 20. And because the mounting member 30 and its front and top walls 32, 42 are at the forward portion of the apparatus 20 and the balance of the apparatus 20 primarily in the form of the rearwardly extending capture member 50 is at or defines the central and rearward portions of the apparatus 20, the center of gravity of the apparatus 20 is thus rearward of the front mounting member 30, causing the overall apparatus 20 to pivot about the top wall 42 or top wall edge 46 when the apparatus 20 is so positioned on a door frame D as shown, causing the apparatus 20 to effectively rotate about the contact point between the top wall edge 46 and the front or first trim T1, counter-clockwise in the view of FIG. 4, so as to cause the upper face 54 of the capture member 50 to naturally come into contact with and rest against the bottom surface of the rear or second trim T2 or other structure, again whether or not the upper face 54 is formed having ridges 56 or other surface treatment, which in the illustrated embodiment do contact and nest against or capture the lower corner of the rear or second trim T2. In the exemplary embodiment wherein the top wall edge 46 is slightly slanted from bottom to top, it will be appreciated that even before the apparatus 20 is under load, or when it is perhaps most rotated clockwise in the view of FIG. 4, the slanted edge 46 allows the edge 46 to still fully seat in the corner between the front or first trim T1 and the outer or first surface S1 of the wall W, further ensuring sufficient positive engagement between the mounting member 30, and the top wall 42 particularly, and the front or first trim T1 of the door frame D. Of course, this assumes a conventional door frame D involving a substantially vertical wall W in which is formed a doorway having or in part defined by a substantially horizontal head stop E that is then trapped or faced by the opposing substantially horizontal first and second trims T1, T2, it again being understood that a wide variety of other structures may be utilized in conjunction with a training apparatus 20 according to aspects of the present invention. Once more, the upper face 54 of the capture member 50 may be formed having widthwise ridges 56 that may further facilitate seating or engagement of the capture member 50 with the door frame D, or here again the bottom surface of the rear or second trim T2, though this is not necessarily the case and such ridges 56 are again optional as is any other surface treatment of the capture member upper face 54, in whole or in part. For ease of illustration, the training apparatus 20 is again shown as not having a grip member 90 (FIGS. 12 and 13) installed thereon, though it will be appreciated that such would typically be installed on each apparatus 20 prior to use as shown and described below in connection with FIGS. 12 and 13. As so installed, the front or outer face 34 of the front wall 32 of the mounting member 30 and particularly the receiver 38 is accessible for installation thereon of an outwardly protruding grip member 90 while the back or inner face 36 of the front wall 32 is in the exemplary embodiment clear of the front or first trim T1, with again the top wall 42 and particularly its bottom face 44 and/or its edge 46 is in contact with the door frame front trim T1 to support the training apparatus 20 thereon. Fundamentally, it will be appreciated by those skilled in the art that a portable frame-mounted training apparatus 20 according to aspects of the present invention is configured so as to be temporarily installed, mounted, or otherwise secured on an overhead door frame D or other structure employing mechanical camming action, with the apparatus 20 again in the exemplary embodiment pivoting on one side of the door frame D about its mounting member 30, or top wall 42 specifically, that acts as a fulcrum so as to cause the apparatus' rearwardly-extending capture member 50 to engage with or seat against the opposite side of the door frame D. And those skilled in the art will appreciate that the more force that is then applied to the mounting member 30, as by performing exercises on the training apparatus 20, the more rotation or rotational force is caused to the apparatus 20, to a point, thereby further forcing the capture member 50 into contact with or wedging it against the rear side of the doorway or door frame D or other structure or opening, thus effectively camming the apparatus 20 into tighter or more secure engagement on the illustrated door frame D, all without any mechanical fasteners or other attachment means and thus without any modification to the door frame D or the like. Depending on a number of factors including the geometry and material of the apparatus 20 and the amount of loading it is under, the mounting member 30 and/or the capture member 50, or particularly an intermediate location or connecting portion 80 comprising one or both of the mounting and capture members 30, 50, may have sufficient flex to further facilitate loading and unloading the apparatus 20 or its frictional engagement with portions of the door frame D or other structure as herein described. Advantageously, a training apparatus 20 according to aspects of the present invention can be produced relatively inexpensively and in relatively small size (dimension and weight) to render it easily portable. And again, because the apparatus 20 is installed by simply sitting or placing it on a doorway or the like, it can conveniently be taken and used from location to location.

Figure 5:
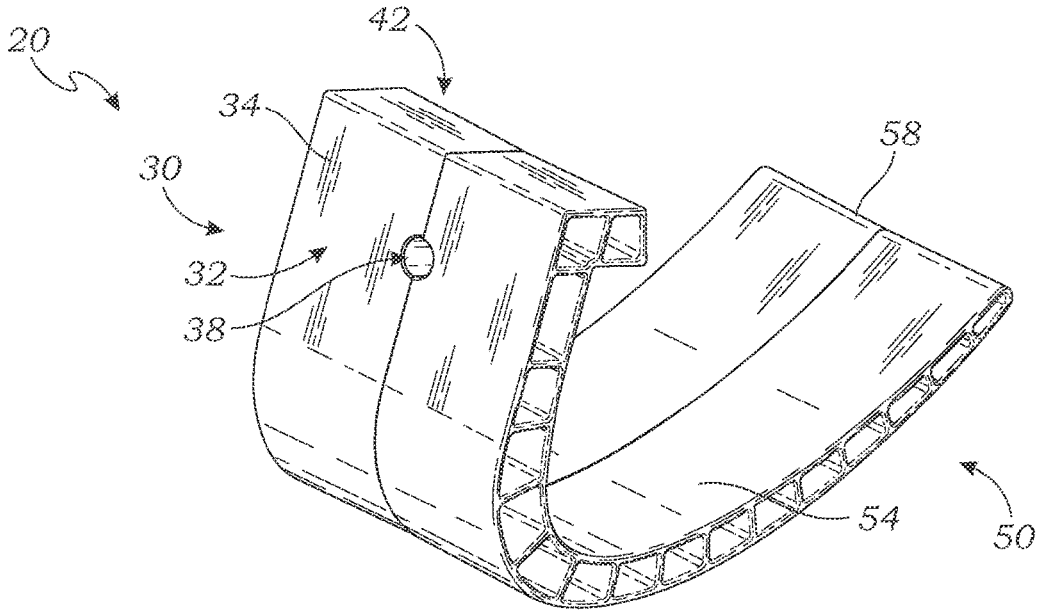
FIG. 5 is a perspective view of an alternative exemplary portable frame-mounted training apparatus, in accordance with at least one embodiment.
Figure 6:
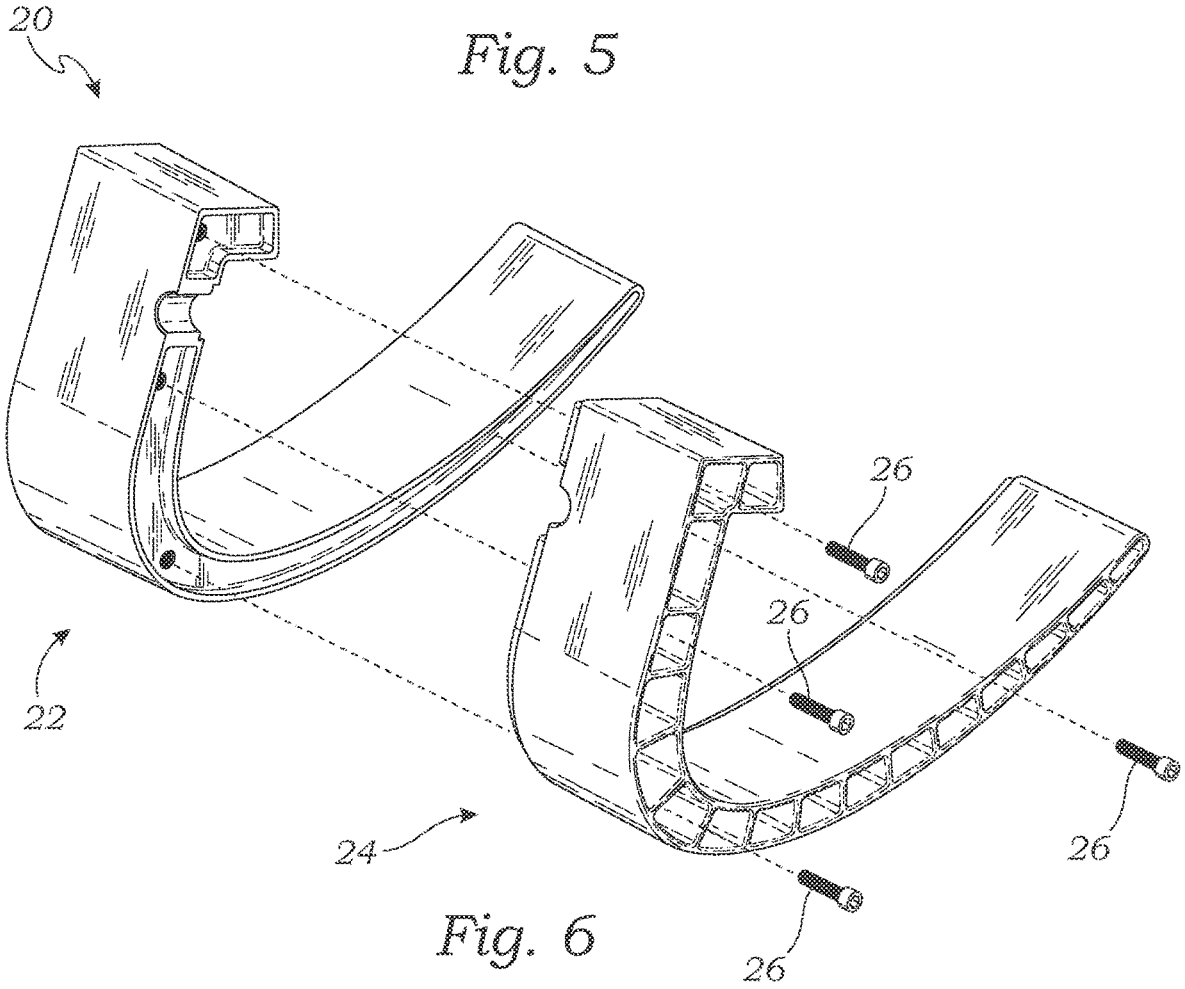
FIG. 6 is an exploded perspective view thereof, in accordance with at least one embodiment.
Figure 7:
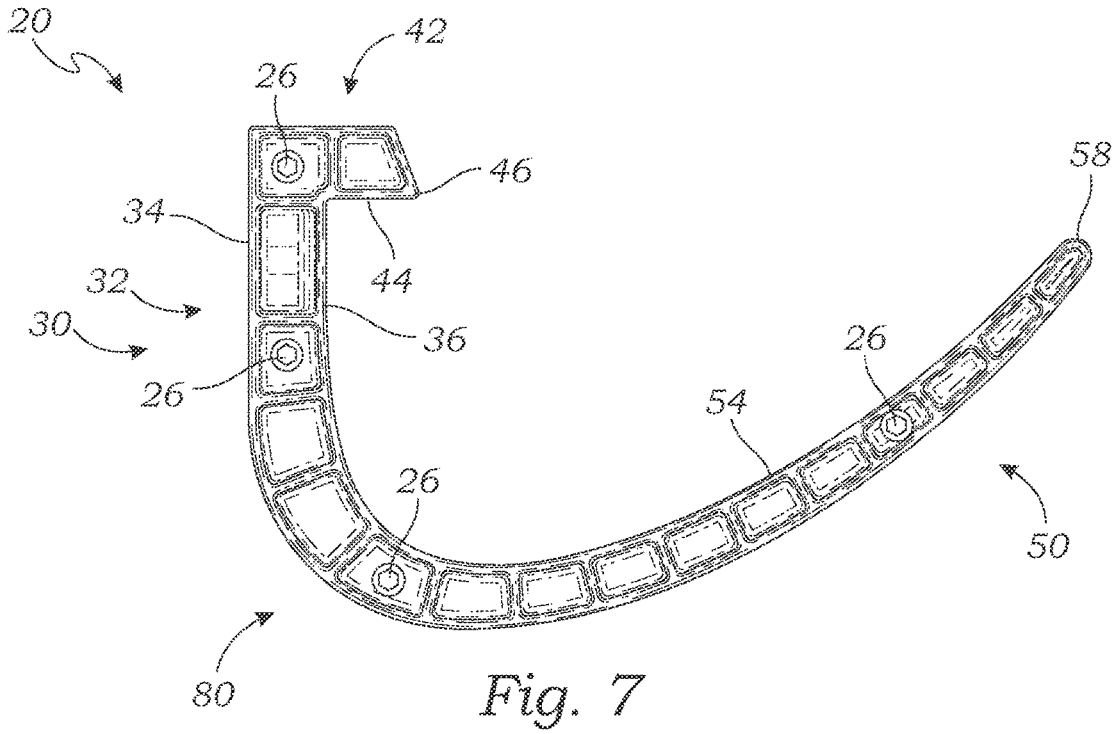
FIG. 7 is a side view thereof, in accordance with at least one embodiment.
Figure 8:
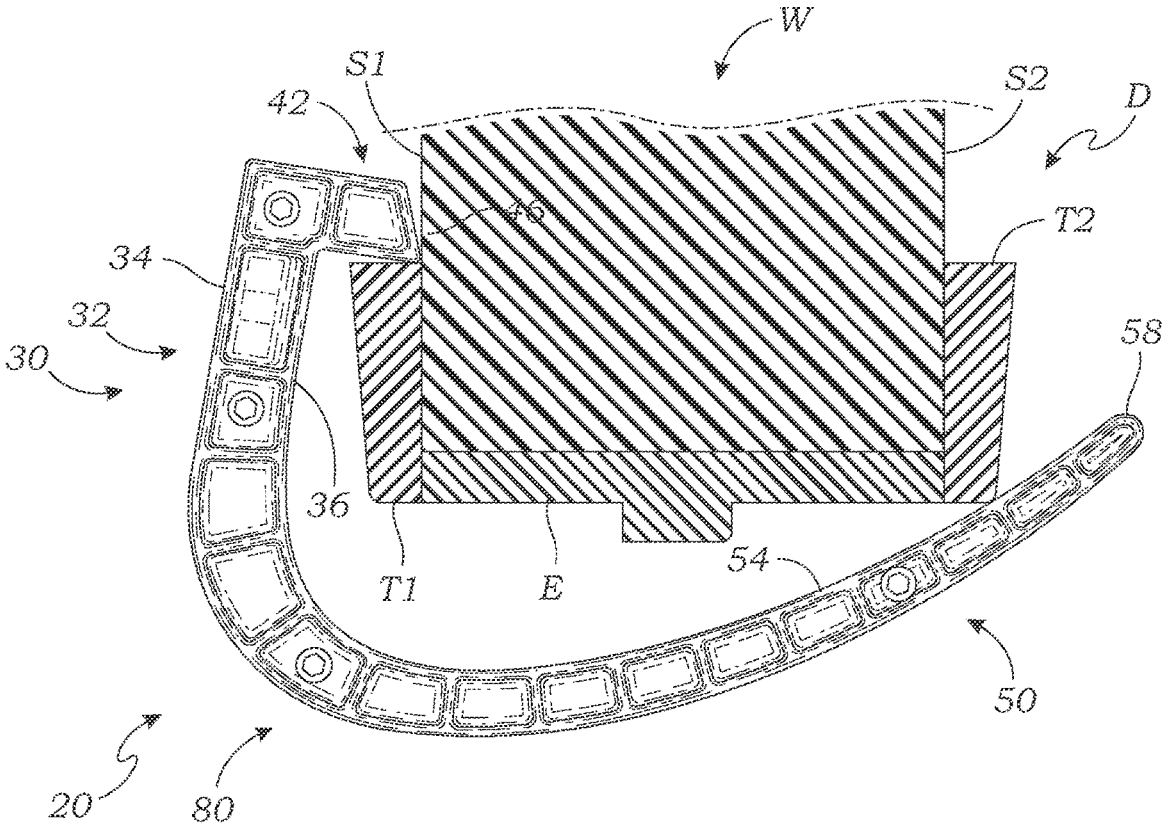
FIG. 8 is a side view thereof as temporarily mounted on a door frame, illustrated partially and schematically in section, in accordance with at least one embodiment.

Referring next to FIGS. 5 and 6 illustrating assembled and exploded perspective views of an alternative exemplary training apparatus 20 according to aspects of the present invention, the apparatus 20 here comprises first and second lengthwise halves 22, 24, which may be joined via screws 26 or other fasteners as illustrated, press- or interference-fit, solvent bonding, ultrasonic welding, fusing, or any other such assembly technique, whether or not permanent and whether now known or later developed in the art. Once so assembled, the resulting apparatus 20 is otherwise analogous to the exemplary embodiment of FIGS. 1-4 in that it generally comprises a forward mounting member 30 and an interconnected rearward capture member 50 that are again here integral lengthwise, though not necessarily so. Both the mounting member 30 and connecting member 50 are shown as being of a somewhat honeycomb construction or configuration rather than being solid, which it will be appreciated would reduce the total amount of material in the device and thus weight and cost while still maintaining the desired strength or mechanical properties. Here regarding the mounting member 30, it can be seen that the receiver 38 is formed as a smooth-bore through-hole that is counterbored from the back or at the inner face 36 of the front wall 32. Those skilled in the art will appreciate that such a receiver 38 would then be able to accommodate a fastener such as a weld nut 100 (FIG. 12) or the like having a flange on one side from which extends a boss having the desired female thread formed therein, the outside diameter or dimension of the boss or other such feature of a weld nut 100 or the like would then substantially correspond to the inside diameter or dimension of the hole in the front wall 32 so as to then define the receiver 38, it being appreciated that in such an exemplary embodiment the flange of the weld nut 100 would again be oriented toward the inner face 36 of the front wall 32 of the mounting member 30, here configured so as to seat in the receiver counterbore so that the weld nut 100 or the like would then be substantially flush with the front wall inner face 36. As best seen in the side view of FIG. 7, the front wall 32 and particularly its outer face 34 is substantially flat or planar to further facilitate installation of a grip member 90 (FIGS. 12 and 13) thereon. And the interface between the front and top walls 32, 42, or particularly between the inner face 36 of the front wall 32 and the bottom face 44 of the top wall 42, defines a transition that is a filleted or radiused joint or intersection for further mechanical integrity. Each half 22, 24 of the alternative exemplary two-half apparatus 20 of FIGS. 5-8 may be molded or extruded width-wise not only to form such features as radiused corners but also with a roughly one-half degree (0.5°) draft angle from outer edge to inner edge, or more generally a taper in the range of zero to five degrees (0-5°), rendering the apparatus 20 slightly larger at the outer edges, which it will be appreciated in use ensures contact on the door frame D trim T1, T2 or other support structure at the opposite outer edges of the top wall 42 so that it is further ensured that the apparatus 20 seats squarely on the exemplary door frame D with no lateral or side-to-side or width-wise rocking. However, it will be appreciated that such draft angle feature that is further facilitated by forming the apparatus 20 in two halves 22, 24 is entirely optional and, moreover, that such feature can also be achieved without necessarily forming the apparatus 20 in two lengthwise parts as illustrated. Furthermore, whether formed as a single, unitary construction or in two or more parts, the apparatus 20 may fundamentally be configured with substantially straight edges or planar surfaces for substantially square or stable contact with the door frame D trim T1, T2 or other such structure, such that any and all such configurations of the apparatus 20 and its mating features are encompassed by aspects of the present invention, which is not limited to any such configuration and all of which are to be understood as illustrative and non-limiting. By way of further illustration and not limitation, it is noted with continued reference to FIGS. 5-7 that here the upper face 54 of the capture member 50 is smooth, not being formed with any ridges or other surface treatment for engagement with the door frame D or the like. In use, then, as shown in FIG. 8, the alternative exemplary training apparatus 20 according to aspects of the present invention may be positioned on an exemplary door frame D by simply placing the mounting member 30, and particularly the top wall 42 thereof, on or in contact with the first trim T1 of the door frame D such that the capture member 50 is oriented rearwardly and is in contact with the opposite second trim T2 of the door frame D. Those skilled in the art will again appreciate that gravity alone would serve to maintain the apparatus 20 so positioned on the door frame D, without the need for any other means of attachment. It will also be appreciated once more that for ease of illustration the training apparatus 20 is again shown as not having a grip member 90 (FIGS. 12 and 13) installed thereon, which would typically be installed on the apparatus 20 prior to use as shown and described below in connection with FIGS. 12 and 13.

Figure 9:
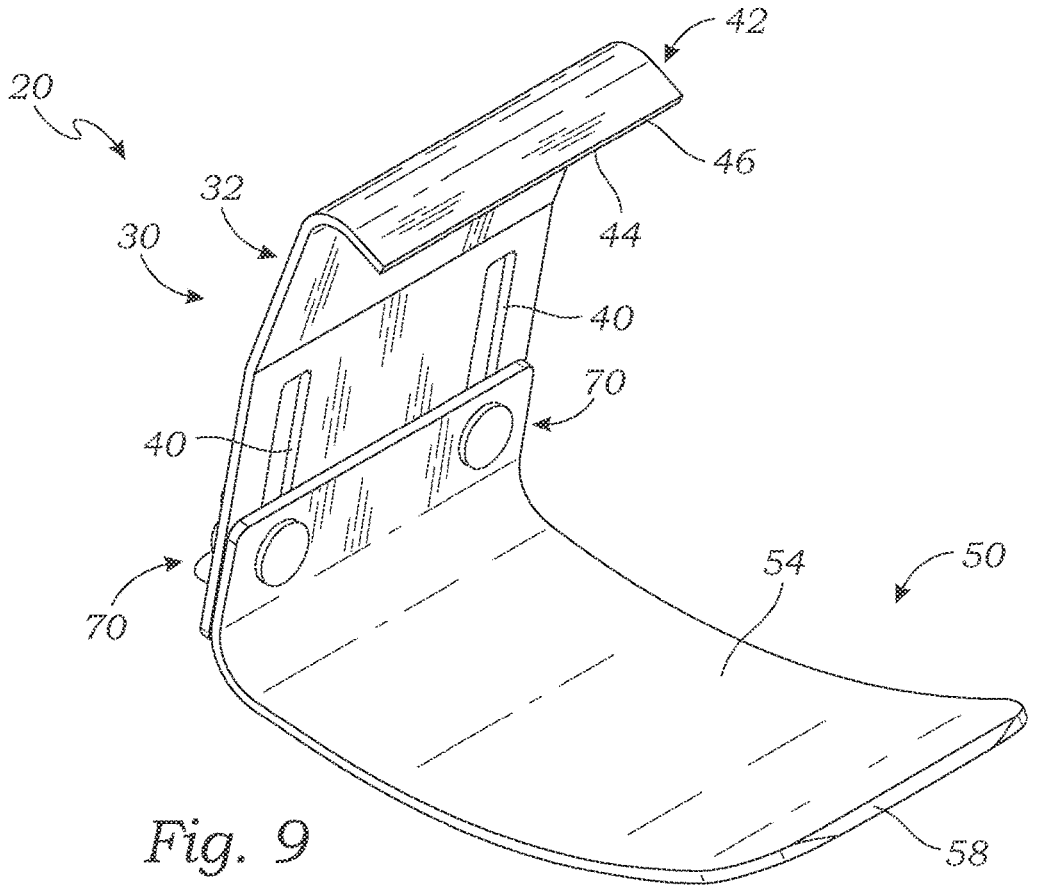
FIG. 9 is a perspective view of a further alternative exemplary portable frame-mounted training apparatus, in accordance with at least one embodiment.
Figure 10:
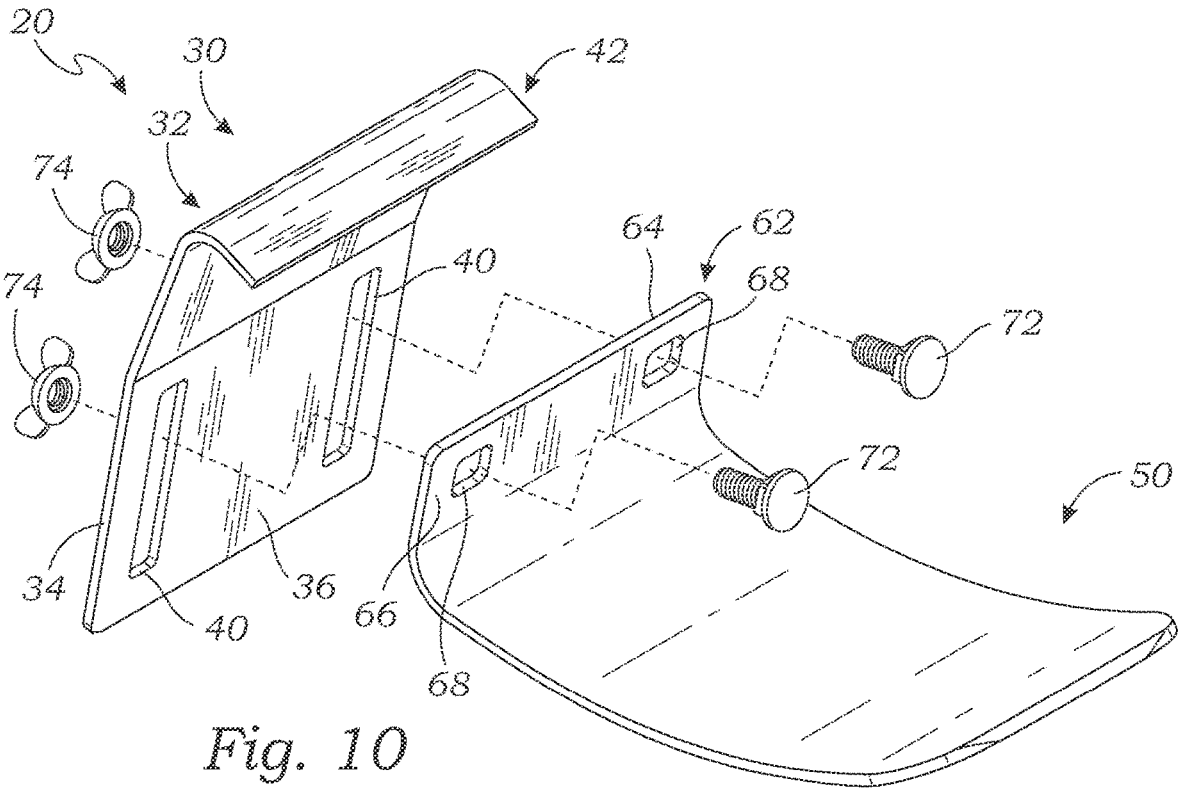
FIG. 10 is an exploded perspective view thereof, in accordance with at least one embodiment.
Figure 11:
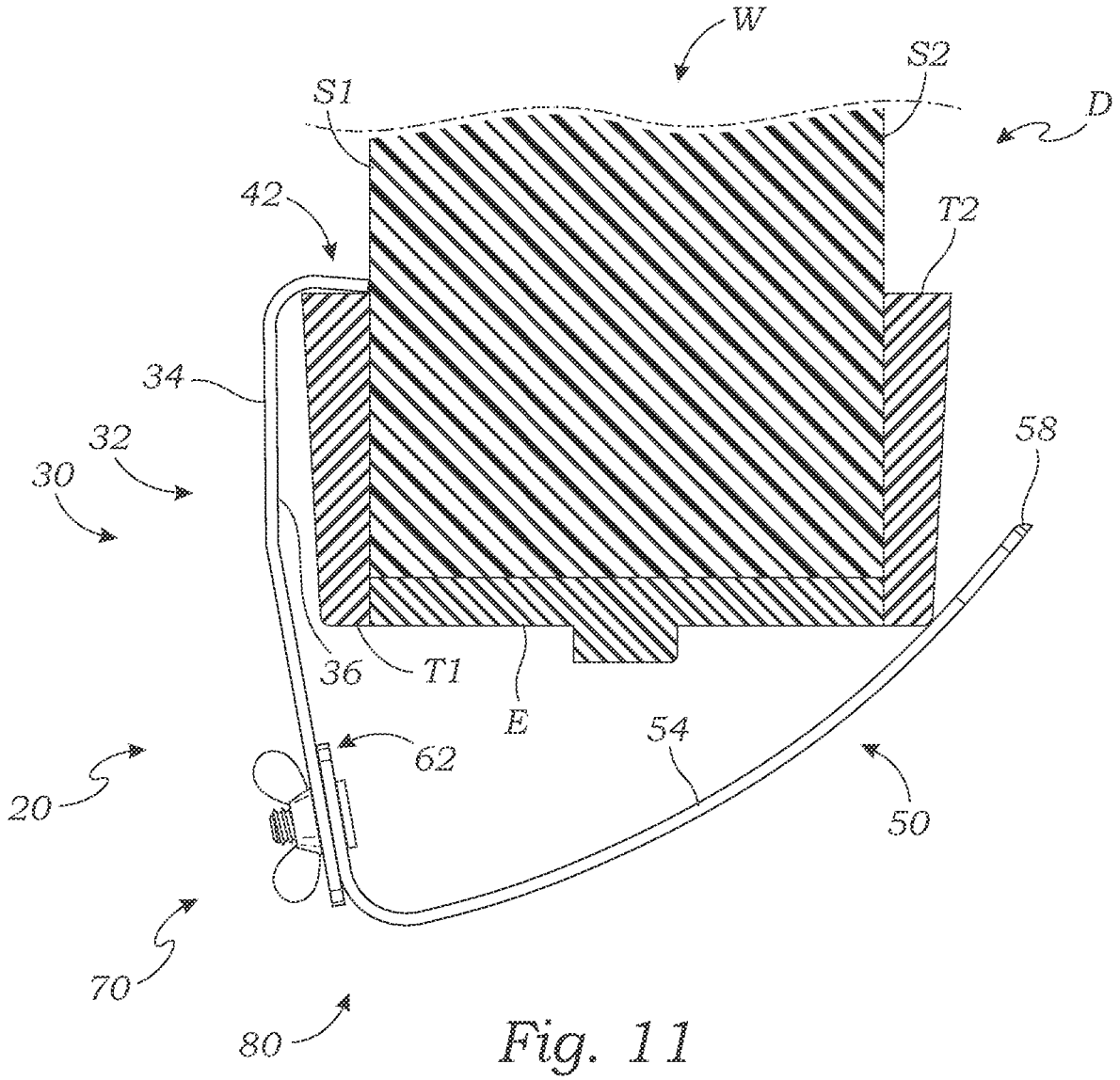
FIG. 11 is a side view thereof as temporarily mounted on a door frame, illustrated partially and schematically in section, in accordance with at least one embodiment.

Turning to FIGS. 9-11, there are shown assembled and exploded views and a side view illustrating use of a further alternative exemplary portable frame-mounted training apparatus 20 according to aspects of the present invention. Here, the mounting member 30 and the capture member 50 are formed as two separate components functionally assembled via fasteners 70 so as to render the apparatus 20 adjustable, particularly in height or the dimension from the top of the mounting member 30 to the capture member 50, so as to accommodate a variety of door frame D or other structural configurations, particularly as to the height of any trim T1, T2. In a bit more detail, the mounting member 30 has spaced-apart lengthwise slots 40 formed in its front wall 32 so as to communicate between the opposite outer and inner faces 34, 36. And the capture member 50 is formed having a front wall 62 configured to be substantially parallel to and to slide along the mounting member front wall 32 when the apparatus 20 is assembled, or more particularly there is substantially flush, slidable engagement between the inner face 36 of the mounting member front wall 32 and the outer face 64 of the capture member front wall 62. The capture member front wall 62 is thus likewise formed with spaced-apart openings 68 that communicate between the capture member front wall outer and inner faces 64, 66 and are substantially aligned with or correspond with the spaced-apart slots 40 formed in the mounting member front wall 32. Thus, as shown, with the mounting member and capture member front walls 32, 62 substantially adjacent and the respective slots 40 and openings 68 aligned, fasteners 70 can be inserted or installed within the respective slots 40 and openings 68 so as to then assemble the mounting and capture members 30, 50 together in forming the adjustable training apparatus 20. In the exemplary embodiment, each such fastener 70 comprises a screw 72 and a threadably engaged wingnut 74, though any other fastener or fastening means now known or later developed may be employed. In the case of the illustrated screw and wingnut fastener 70, the screw 72 is inserted from the back or with its head adjacent to the inner face 66 of the capture member front wall 62 so that the threaded end of the screw 72 extends through both the opening 68 and the slot 40 formed in the mounting member front wall 32 so as to extend beyond the outer face 34 thereof and be accessible for threadable engagement of a wingnut 74 or the like. Those skilled in the art will appreciate that with the apparatus 20 so configured and assembled, and particularly due to the mounting member front wall 32 being formed with lengthwise slots 40, the capture member 50 can thus be shifted up or down or vertically relative to the mounting member 30, as by shifting the fasteners 70 within the slots 40, and thereby adjust the overall dimension of the apparatus 20 or particularly its height or the distance between the mounting member top wall 42 and the capture member 50. When the apparatus 20 is in the desired configuration, the fasteners 70 may be secured as by tightening the wingnut 74—for illustration and not limitation, the screw 72 may be formed having a square or hex body adjacent its head for seating within a similarly configured non-round opening 68 in the capture member front wall 62 so as to prevent the screw 72 from rotating as the wingnut 74 is tightened in a manner known in the art. Thus, an adjustable training apparatus 20 is provided such that in use it can be more optimally configured for a particular door frame D or other geometry. And so as illustrated in FIG. 11, when the apparatus 20 is to be positioned on a relatively taller door frame D or on a door frame D having relatively taller or wider trim T1, T2, the apparatus 20 may be adjusted accordingly as by shifting the fasteners 70 down in the slots 40 and thus the capture member 50 down or lower relative to the mounting member 30 so that there is effectively proper spacing between the ledge or top wall 42 of the mounting member 30 and the capture member 50 so that in use the top wall 42 engages the top surface of the front or first trim T1 of the door frame D and the upper face 54 of the capture member 50 engages the bottom surface of the opposite back or second trim T2. It will be appreciated by those skilled in the art that a wide variety of such configurations of the mounting and capture members 30, 50 and the overall apparatus 20 are possible according to aspects of the present invention without departing from its spirit and scope. By way of further illustration and not limitation, while pairs of slots 40 and openings 68 and related fasteners 70 are shown, a single fastener or fastening means or three or more fasteners or fastening means could also be employed. More generally, while the alternative exemplary embodiment of FIGS. 9-11 is shown as being perhaps formed from metal as through a stamping, bending, or forming process, it will be appreciated once again that any such training apparatus 20 can be formed of any appropriate material and manufacturing process now known or later developed without departing from the spirit and scope of the invention. It is also noted that while no receiver 38 (FIGS. 1-8) is shown in the alternative exemplary embodiment of FIGS. 9-11 simply for ease of illustration, in the front wall 32 of the mounting member 30 or otherwise, any appropriate receiver or attachment means for selectively securing a grip member 90 (FIGS. 12 and 13) on the mounting member 30 of the apparatus, whether now known or later developed as being consistent with the spirit and scope of the invention, may be employed.

Figure 12:
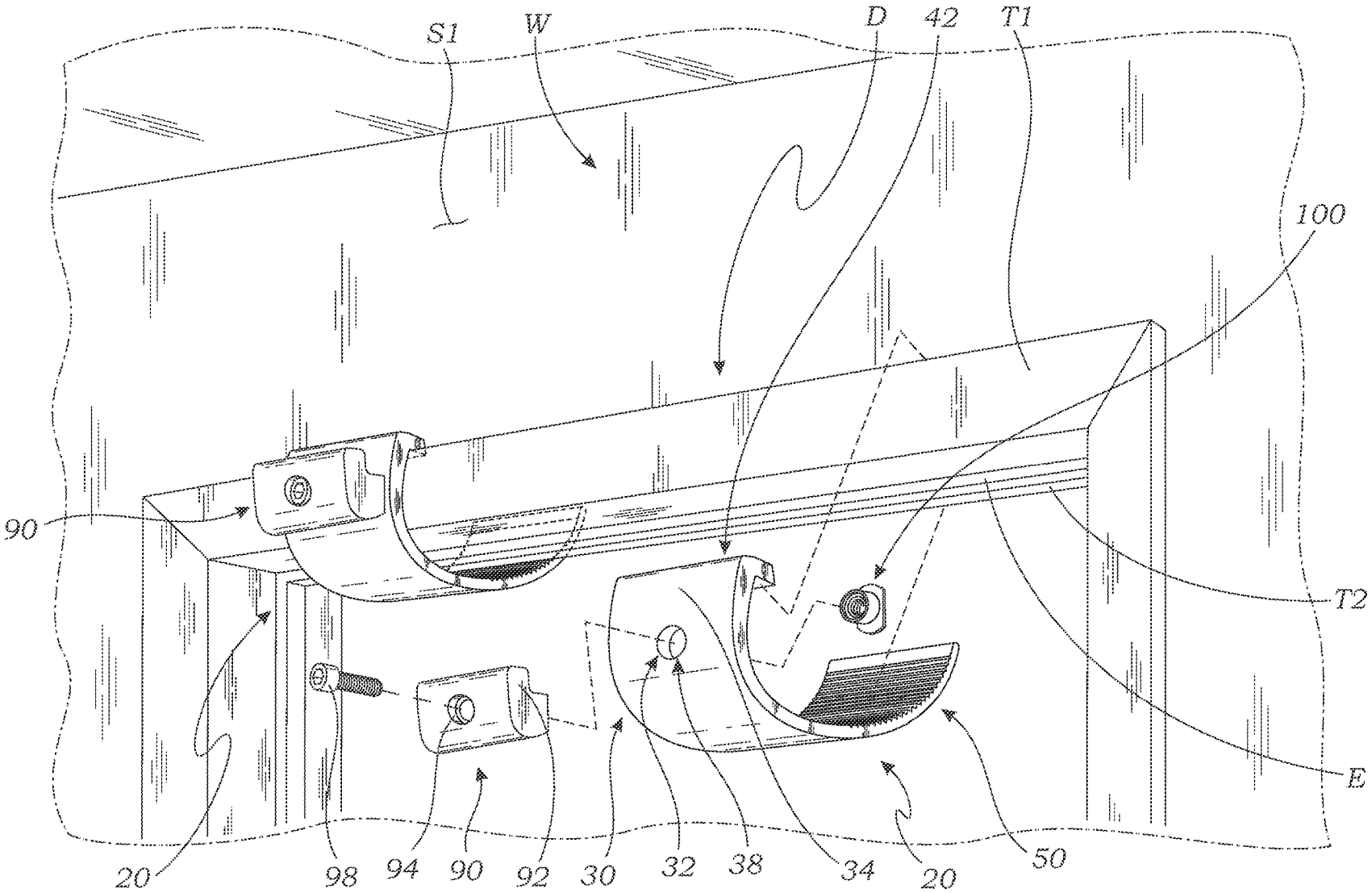
FIG. 12 is a reduced-scale perspective view of two spaced-apart training apparatuses as per FIGS. 1-4, illustrated partially exploded with regard to selectively attachable grips, as temporarily mounted on a door frame, illustrated partially, in accordance with at least one embodiment.
Figure 13:
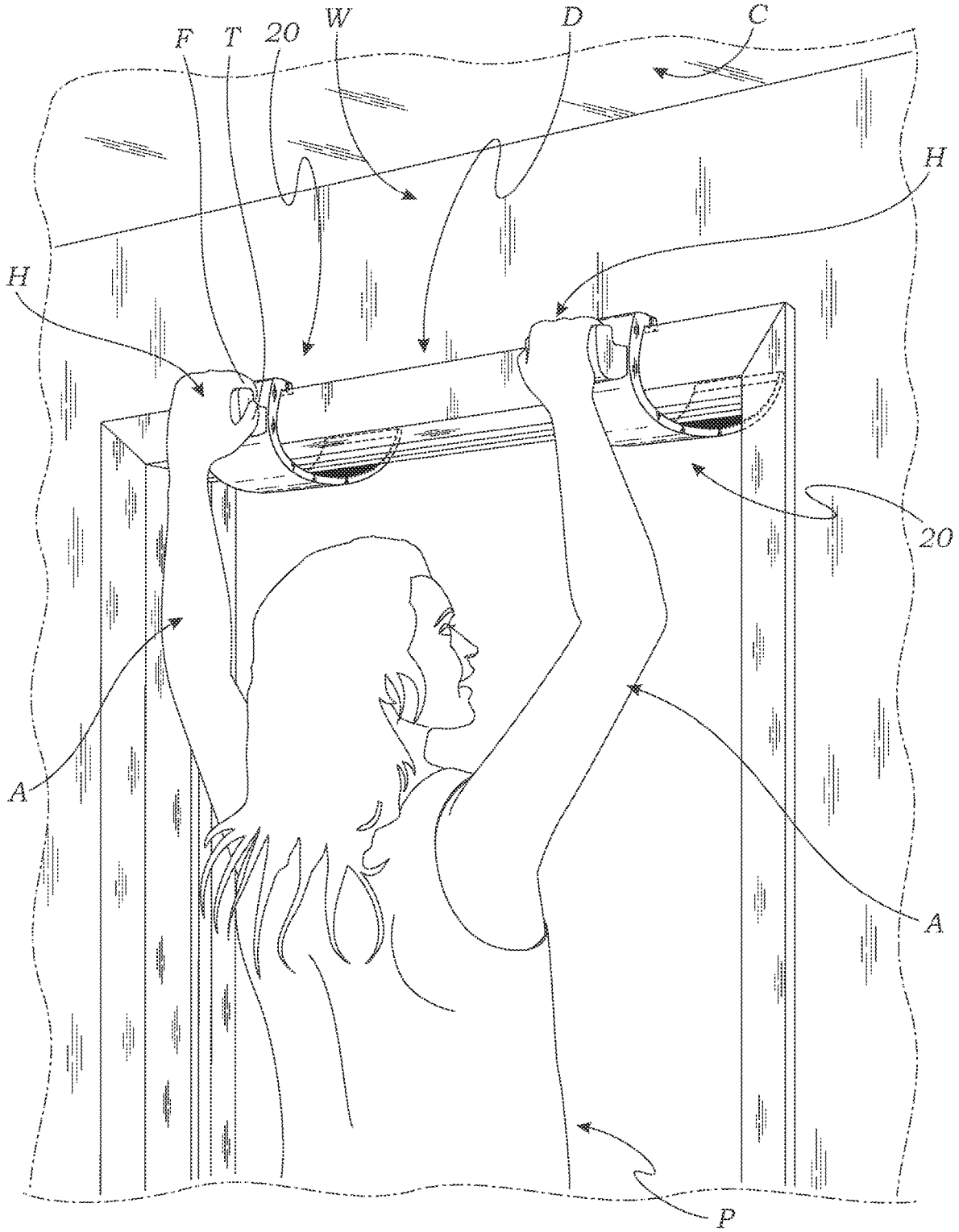
FIG. 13 is a reduced-scale perspective view of the two spaced-apart training apparatuses of FIG. 12 as temporarily mounted on a door frame, illustrated partially, and now in use, in accordance with at least one embodiment.

Finally, referring now to FIGS. 12 and 13, in use, a portable frame-mounted training apparatus 20 according to aspects of the present invention may be removably or non-permanently installed on an exemplary door frame D forming a doorway within a wall W as again by simply positioning the mounting member 30, and particularly the top wall 42 thereof, on or in contact with the first trim T1 of the door frame D such that the capture member 50 is oriented rearwardly and is in contact with the opposite second trim T2 or other structure of the door frame D or the like as explained herein. While an exemplary training apparatus 20 as shown and described in connection with FIGS. 1-4 is here depicted in use, it will be appreciated that other alternative embodiments, such as shown and described herein or otherwise, may instead be employed as again may be contexts other than the illustrated typical doorway or door frame D with opposed first and second trims T1, T2. Prior to use, it is most common and preferable to first install a selected grip member 90 on each apparatus 20, though depending on the attachment means and other factors, a grip member 90 could instead be installed on the apparatus 20 after it is in place on a door frame D or the like or in some cases exercises may be performed without the use of a grip member 90, as for example by grasping the top wall 42 itself for a small finger ledge or hold. But in the most typical scenario of selectively installing a grip member 90 on each apparatus 20 prior to use, or prior to placing the apparatus 20 on the door frame D, it will be appreciated with particular reference to FIG. 12, and more particularly the exploded view of the apparatus 20 on the right side of the illustrated door frame D, that the selected grip member 90 is removably installed on the outer face 34 of the front wall 32 of the mounting member 30 as by passing a screw or other such fastener 98 through an appropriately sized and optionally counterbored grip hole 94 formed in the grip member 90 and then threadably engaging such fastener 98 with a corresponding threaded receiver 38 in the front wall 32 of the mounting member 30, here shown as comprising a flanged nut 100 inserted into the front wall 32 of the mounting member 30 from the back. Again, such threaded receiver 38 may comprise female threads formed in the mounting member front wall 32 itself or as shown here a separate nut 100 installed or inserted within the mounting member front wall 32 as herein described. And once more, those skilled in the art will appreciate that a wide variety of means for mounting a grip member 90 on the mounting member 30 of the apparatus 20, whether now known or later developed, are possible according to aspects of the present invention, such that the particular means shown and described is to be understood as illustrative and non-limiting. Once each training apparatus 20 is so configured as desired, each is again placed on the door frame D as disclosed herein. In typical usage, two such apparatuses 20 would be employed together as shown, spaced apart along the illustrated horizontal door frame D header or top trim T1, T2. For example, the apparatuses 20 may be positioned along the door frame D approximately shoulder width apart for performing a pull-up exercise. Indeed, as shown in FIG. 13, two spaced-apart apparatuses 20 each having a grip member 90 mounted thereon may be positioned on opposite sides of a conventional doorway door frame D. A person P wishing to exercise or train may then grasp each grip member 90 or specifically any grip feature 92 thereof, one hand H on each, as by grasping the respective grip feature 92 with finger(s) F and/or thumb T as appropriate and then performing a pull-up exercise or raising the body toward the ceiling C so as to exercise the arms A and hands H, with such exercise then repeated as per the particular training regimen the person P is engaged in. And when any such exercise or training session is concluded, the apparatus(es) 20 may simply be lifted off of the door frame D or other support structure and stored or transported as desired. Or the grip member(s) 90 may be replaced, the apparatus(es) 20 repositioned on the door frame D, and further training continue. Those skilled in the art will also appreciate that in some uses only one apparatus 20 might be employed, as when doing a one-arm pull-up or a two-arm pull-up from a single hold. Or three or more apparatuses 20 may be employed in one training session so as to offer further variety in grips or holds and the opportunity to make transitions from one hold to another during training to simulate rock climbing maneuvers. And when two or any number of apparatuses 20 are used, it will be appreciated that each could have the same style grip member 90, as depicted in FIGS. 12 and 13, or some mixture or assortment of grips, again for a number of reasons related to the training objectives. More generally, it will be appreciated by those skilled in the art that a training apparatus 20 according to aspects of the present invention provides a door hanger-type device having a ledge capturing apparatus connected to a relatively flexible door jamb clamping apparatus with an integrated attachment point with interchangeable holds. Thus, a variety of configurations of such an apparatus 20 beyond those shown and described are possible according to aspects of the present invention without departing from its spirit and scope, again, for use on a variety of doorway configurations and other structures.

Aspects of the present specification may also be described as follows:

1. A training apparatus for removable installation on a door frame having at least one horizontal trim, the apparatus comprising: a mounting member having a front wall with a receiver and further having a top wall extending rearwardly from the front wall, the top wall configured to engage the door frame first trim; and a capture member extending rearwardly from the mounting member and having an upper face configured to contact the door frame second trim or other structure somewhat opposite of the first trim; wherein the receiver formed in the front wall of the mounting member is configured for selective removable receipt of a grip member for grasping during a training exercise employing the apparatus; and whereby engagement of the top wall of the mounting member with the first trim serves as a pivot point for the apparatus to gravitationally bring the upper face of the capture member into contact with the second trim or other structure and thereby secure the apparatus on the door frame.

2. The apparatus of embodiment 1 wherein the front wall has an outer face and an opposite inner face.

3. The apparatus of embodiment 2 wherein the receiver communicates between the outer face and the inner face.

4. The apparatus of embodiment 2 or embodiment 3 wherein the receiver is threaded.

5. The apparatus of any of embodiments 2-4 wherein the receiver is counterbored at the inner face.

6. The apparatus of any of embodiments 2-5 wherein the receiver comprises a flanged nut with internal thread.

7. The apparatus of any of embodiments 2-6 wherein the outer face is planar.

8. The apparatus of any of embodiments 2-7 wherein the top wall has a bottom face contiguous with the inner face.

9. The apparatus of embodiment 8 wherein the bottom face and the inner face are approximately perpendicular.

10. The apparatus of embodiment 8 or embodiment 9 wherein the intersection between the bottom face and the inner face is radiused.

11. The apparatus of any of embodiments 8-10 wherein the top wall terminates rearwardly in an edge.

12. The apparatus of embodiment 11 wherein the edge is at an acute angle to the bottom face.

13. The apparatus of any of embodiments 1-12 wherein the capture member has a tip opposite the mounting member.

14. The apparatus of embodiment 13 wherein the length of the apparatus from the front wall of the mounting member to the tip of the capture member is approximately nine inches (9 in.).

15. The apparatus of embodiment 13 or embodiment 14 wherein the height of the apparatus from the top wall of the mounting member to the capture member is approximately six inches (6 in.).

16. The apparatus of any of embodiments 13-15 wherein the width across the mounting member and/or capture member is approximately four inches (4 in.).

17. The apparatus of any of embodiments 1-16 wherein the upper face of the capture member is smooth.

18. The apparatus of any of embodiments 1-16 wherein the upper face of the capture member is formed having lateral ridges.

19. The apparatus of any of embodiments 1-18 wherein the upper face of the capture member is curved.

20. The apparatus of any of embodiments 1-19 wherein the capture member is curved.

21. The apparatus of any of embodiments 1-20 wherein the capture member is flexible.

22. The apparatus of any of embodiments 1-21 wherein a flexible connecting portion interconnects the mounting member and the capture member.

23. The apparatus of any of embodiments 1-22 comprising a lengthwise first half and an adjacent lengthwise second half, each such half defining a widthwise portion of the mounting member and of the capture member.

24. The apparatus of embodiment 23 wherein each of the first and second halves is tapered about its perimeter widthwise.

25. The apparatus of embodiment 23 or embodiment 24 wherein each of the first and second halves have a draft angle in the range of zero to five degrees (0-5°) widthwise from outside edge to inside edge.

26. The apparatus of any of embodiments 1-25 wherein the mounting member and the capture member are integral.

27. The apparatus of any of embodiments 1-25 wherein the mounting member and the capture member are separate components assembled together to form the apparatus.

28. The apparatus of embodiment 27 wherein the capture member is formed having an upwardly-oriented capture member front wall substantially parallel to the mounting member front wall.

29. The apparatus of embodiment 27 or embodiment 28 wherein spaced-apart lengthwise slots are formed in the mounting member front wall.

30. The apparatus of embodiment 29 wherein spaced-apart openings are formed in the capture member front wall corresponding to the slots.

31. The apparatus of embodiment 30 wherein selectively operable fasteners are positioned within the mounting member front wall slots and the capture member front wall openings to selectively adjustably assemble the capture member relative to the mounting member.

32. The apparatus of embodiment 31 wherein each fastener comprises a screw and wingnut.

33. The apparatus of any of embodiments 1-32 wherein the mounting member and the capture member are solid.

34. The apparatus of any of embodiments 1-32 wherein the mounting member and the capture member are hollow.

35. The apparatus of any of embodiments 1-32 wherein the mounting member and the capture member are of honeycomb construction.

36. A method of employing a training apparatus as defined in any one of embodiments 1-35, the method comprising the steps of: engaging the top wall of the mounting member with the first trim of the door frame; and gravitationally pivoting the apparatus about the contact point between the top wall and the first trim so as to contact the second trim or other structure of the door frame with the upper face of the capture member.

37. The method of embodiment 36, further comprising the step of selectively mounting a grip member on the mounting member.

38. The method of embodiment 37, wherein the step of mounting a grip member comprises passing a screw through a grip hole formed in the grip member so as to threadably engage the receiver formed in the mounting member front wall.

39. The method of embodiment 38, wherein the step of mounting a grip member further comprises inserting a flanged nut within the receiver from the back of the mounting member front wall for threadable engagement with the screw.

40. The method of any of embodiments 36-39, further comprising the step of selectively adjusting the position of the capture member relative to the mounting member to account for the configuration of the door frame.

41. The method of embodiment 40, wherein the step of selectively adjusting the position of the capture member relative to the mounting member comprises selectively loosening a fastener assembling the mounting member and the capture member so as to slide the capture member relative to the mounting member.

42. The method of embodiment 40 or embodiment 41, wherein the step of selectively adjusting the position of the capture member relative to the mounting member comprises selectively tightening the fastener assembling the mounting member and the capture member so as to secure the capture member relative to the mounting member.

43. The method of any of embodiments 36-42, further comprising the step of placing two apparatuses on the door frame.

44. The method of embodiment 43, further comprising the step of grasping the apparatuses to perform a training exercise.

45. The method of embodiment 44, wherein the step of grasping the apparatuses further comprises grasping a grip feature of the grip member.

46. The method of any of embodiments 36-45, further comprising the step of removing the apparatus from the door frame by pivoting the capture member away from the second trim or other structure of the door frame about the contact point between the top wall and the first trim and then lifting the top wall off of the first trim.

47. The method of any of embodiments 36-46, comprising the further step of selectively storing the apparatus.

48. The method of any of embodiments 36-47, comprising the further step of selectively transporting the apparatus.

49. A kit comprising a training apparatus as defined in any one of embodiments 1-35.

50. The kit of embodiment 49, further comprising two apparatuses.

51. The kit of embodiment 49 or embodiment 50, further comprising a plurality of grip members.

52. The kit of any of embodiments 49-51, further comprising a plurality of grip member fasteners.

53. The kit of any of embodiments 49-52, further comprising instructional material.

54. The kit of embodiment 53, wherein the instructional material provides instructions on how to perform the method as defined in any one of embodiments 36-48.

55. Use of a training apparatus as defined in any one of embodiments 1-35 to perform training exercises on a door frame.

56. The use of embodiment 55, wherein the use comprises a method as defined in any one of embodiments 36-48.

In closing, regarding the exemplary embodiments of the present invention as shown and described herein, it will be appreciated that a portable frame-mounted training apparatus is disclosed and configured for removable installation on a door frame having at least one horizontal trim to facilitate training exercises. Because the principles of the invention may be practiced in a number of configurations beyond those shown and described, it is to be understood that the invention is not in any way limited by the exemplary embodiments, but is instead able to take numerous forms without departing from the spirit and scope of the invention. It will also be appreciated by those skilled in the art that the present invention is not limited to the particular geometries and materials of construction disclosed, but may instead entail other functionally comparable structures or materials, now known or later developed, without departing from the spirit and scope of the invention.

Certain embodiments of the present invention are described herein, including the best mode known to the inventor(s) for carrying out the invention. Of course, variations on these described embodiments will become apparent to those of ordinary skill in the art upon reading the foregoing description. The inventor(s) expect skilled artisans to employ such variations as appropriate, and the inventor(s) intend for the present invention to be practiced otherwise than specifically described herein. Accordingly, this invention includes all modifications and equivalents of the subject matter recited in the claims appended hereto as permitted by applicable law. Moreover, any combination of the above-described embodiments in all possible variations thereof is encompassed by the invention unless otherwise indicated herein or otherwise clearly contradicted by context.

Groupings of alternative embodiments, elements, or steps of the present invention are not to be construed as limitations. Each group member may be referred to and claimed individually or in any combination with other group members disclosed herein. It is anticipated that one or more members of a group may be included in, or deleted from, a group for reasons of convenience and/or patentability. When any such inclusion or deletion occurs, the specification is deemed to contain the group as modified thus fulfilling the written description of all Markush groups used in the appended claims.

In some embodiments, the numbers expressing quantities of components or ingredients, properties such as dimensions, weight, concentration, reaction conditions, and so forth, used to describe and claim certain embodiments of the inventive subject matter are to be understood as being modified in some instances by terms such as "about," "approximately," or "roughly." Accordingly, in some embodiments, the numerical parameters set forth in the written description and attached claims are approximations that can vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the inventive subject matter are approximations, the numerical values set forth in any specific examples are reported as precisely as practicable. The numerical values presented in some embodiments of the inventive subject matter may contain certain errors necessarily resulting from the standard deviation found in their respective testing measurements.

Unless the context dictates the contrary, all ranges set forth herein should be interpreted as being inclusive of their endpoints and open-ended ranges should be interpreted to include only commercially practical values. The recitation of numerical ranges of values herein is merely intended to serve as a shorthand method of referring individually to each separate value falling within the range. Unless otherwise indicated herein, each individual value of a numerical range is incorporated into the specification as if it were individually recited herein. Similarly, all lists of values should be considered as inclusive of intermediate values unless the context indicates the contrary.

Use of the terms "may" or "can" in reference to an embodiment or aspect of an embodiment also carries with it the alternative meaning of "may not" or "cannot." As such, if the present specification discloses that an embodiment or an aspect of an embodiment may be or can be included as part of the inventive subject matter, then the negative limitation or exclusionary proviso is also explicitly meant, meaning that an embodiment or an aspect of an embodiment may not be or cannot be included as part of the inventive subject matter. In a similar manner, use of the term "optionally" in reference to an embodiment or aspect of an embodiment means that such embodiment or aspect of the embodiment may be included as part of the inventive subject matter or may not be included as part of the inventive subject matter. Whether such a negative limitation or exclusionary proviso applies will be based on whether the negative limitation or exclusionary proviso is recited in the claimed subject matter.

The terms "a," "an," "the" and similar references used in the context of describing the present invention (especially in the context of the following claims) are to be construed to cover both the singular and the plural, unless otherwise indicated herein or clearly contradicted by context. Further, ordinal indicators—such as "first," "second," "third," etc.—for identified elements are used to distinguish between the elements, and do not indicate or imply a required or limited number of such elements, and do not indicate a particular position or order of such elements unless otherwise specifically stated.

All methods described herein can be performed in any suitable order unless otherwise indicated herein or otherwise clearly contradicted by context. The use of any and all examples, or exemplary language (e.g., "such as") provided with respect to certain embodiments herein is intended merely to better illuminate the inventive subject matter and does not pose a limitation on the scope of the inventive subject matter otherwise claimed. No language in the application should be construed as indicating any non-claimed element essential to the practice of the invention.

It should be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

While aspects of the invention have been described with reference to at least one exemplary embodiment, it is to be clearly understood by those skilled in the art that the invention is not limited thereto. Rather, the scope of the invention is to be interpreted only in conjunction with the appended claims and it is made clear, here, that the inventor(s) believe that the claimed subject matter is the invention.

What is claimed is:

1. A training apparatus for removable installation on a door frame having a horizontal trim, the apparatus comprising:

a mounting member having a vertical front wall with a receiver, the front wall having a forwardly-facing outer face and an opposite rearwardly-facing inner face, the mounting member further having a top wall extending rearwardly from the front wall, the top wall configured to engage the horizontal trim; and a capture member extending rearwardly from the mounting member and having an upwardly-facing upper face configured to contact the door frame from beneath an elevation of the top wall of the mounting member;

wherein the receiver is formed in the front wall of the mounting member and is configured for selective removable receipt of a grip member adjacent to the outer face for grasping during a training exercise employing the apparatus; and whereby in use engagement of the top wall of the mounting member with the horizontal trim serves as a pivot point for the apparatus to rotationally bring the upper face of the capture member upwardly into contact with the door frame and thereby secure the apparatus on the door frame through mechanical camming action.

2. The apparatus of claim 1 wherein the receiver extends between the outer face and the inner face.

3. The apparatus of claim 1 wherein the receiver is threaded.

4. The apparatus of claim 1 wherein the receiver is counterbored at the inner face.

5. The apparatus of claim 4 wherein the receiver comprises a flanged nut with internal thread.

6. The apparatus of claim 1 wherein the outer face is planar.

7. The apparatus of claim 1 wherein the top wall has a bottom face contiguous with the inner face.

8. The apparatus of claim 7 wherein the bottom face and the inner face are approximately perpendicular.

9. The apparatus of claim 8 wherein the top wall terminates rearwardly in an edge that is at an acute angle to the bottom face.

10. The apparatus of claim 1 wherein the upper face of the capture member is smooth.

11. The apparatus of claim 1 wherein the capture member is curved.

12. The apparatus of claim 1 wherein the capture member is flexible.

13. The apparatus of claim 1 wherein a flexible connecting portion interconnects the mounting member and the capture member.

14. The apparatus of claim 1 comprising a lengthwise first half and an adjacent lengthwise second half, each such half defining a widthwise portion of the mounting member and of the capture member.

15. The apparatus of claim 14 wherein each of the first and second halves is tapered about its perimeter widthwise.

16. The apparatus of claim 15 wherein each of the first and second halves has a draft angle in the range of zero to five degrees (0-5°) widthwise from outside edge to inside edge.

17. The apparatus of claim 1 wherein the mounting member and the capture member are integral.

18. The apparatus of claim 1 wherein the mounting member and the capture member are separate components assembled together to form the apparatus.

19. The apparatus of claim 18 wherein the capture member is formed having an upwardly-oriented capture member front wall substantially parallel to the mounting member front wall, wherein spaced-apart lengthwise slots are formed in the mounting member front wall and spaced-apart openings are formed in the capture member front wall corresponding to the slots, and further wherein selectively operable fasteners are positioned within the mounting member front wall slots and the capture member front wall openings to selectively adjustably assemble the capture member relative to the mounting member.

20. A training apparatus for removable installation on a door frame having a horizontal trim, the apparatus comprising:

a mounting member having a front wall with a receiver, the front wall having an outer face and an opposite inner face, wherein the outer face is planar, the mounting member further having a top wall extending rearwardly from the front wall, the top wall configured to engage the horizontal trim; and a capture member extending rearwardly from the mounting member and having an upwardly-facing upper face configured to contact the door frame;

wherein the receiver is formed in the front wall of the mounting member and is configured for selective removable receipt of a grip member adjacent to the outer face for grasping during a training exercise employing the apparatus; and whereby in use engagement of the top wall of the mounting member with the horizontal trim serves as a pivot point for the apparatus to rotationally bring the upper face of the capture member upwardly into contact with the door frame and thereby secure the apparatus on the door frame through mechanical camming action.

21. A training apparatus for removable installation on a door frame having a horizontal trim, the apparatus comprising:

a mounting member having a front wall with a receiver, the front wall having an outer face and an opposite inner face, the mounting member further having a top wall extending rearwardly from the front wall, the top wall configured to engage the horizontal trim; and a capture member extending rearwardly from the mounting member and having an upwardly-facing upper face configured to contact the door frame, wherein the capture member is flexible;

wherein the receiver is formed in the front wall of the mounting member and is configured for selective removable receipt of a grip member for grasping during a training exercise employing the apparatus; and whereby in use engagement of the top wall of the mounting member with the horizontal trim serves as a pivot point for the apparatus to rotationally bring the upper face of the capture member upwardly into contact with the door frame and thereby secure the apparatus on the door frame through mechanical camming action.

* * * * *